United States Patent [19]

Hauer

[11] Patent Number: 4,911,465

[45] Date of Patent: Mar. 27, 1990

[54] GOLF CLUB CONTAINER WITH EXTENSIBLE WHEELS

[76] Inventor: Harold J. Hauer, 2430 Rolling Hills Drive, Clarkston, Wash. 99403

[21] Appl. No.: 279,641

[22] Filed: Dec. 5, 1988

[51] Int. Cl.[4] ..... B62B 1/12

[52] U.S. Cl. ..... 280/646; 206/315.6; 280/47.26; 280/DIG. 6

[58] Field of Search ..... 280/DIG. 6, 646, 652, 280/47.26; 206/315.6, 315.3, 315.2

[56] References Cited

U.S. PATENT DOCUMENTS

| | | | |
|---|---|---|---|
| 2,760,782 | 8/1956 | Hartzell | 280/DIG. 6 |
| 2,860,679 | 11/1958 | Kouke | 206/315.6 |
| 2,950,748 | 8/1960 | Olinghouse | 280/DIG. 6 |
| 3,014,732 | 12/1961 | Schemenauer | 280/DIG. 6 |
| 3,101,108 | 8/1963 | Ingoldt | 206/315.6 |
| 3,554,255 | 1/1971 | Mangan | 206/315.6 |
| 3,883,150 | 5/1979 | Varela | 280/DIG. 6 |
| 3,985,373 | 10/1976 | Widegren | 280/DIG. 6 |
| 4,194,547 | 3/1980 | Sidor et al. | 206/315.6 |
| 4,332,283 | 1/1982 | Rader | 206/315.6 |
| 4,497,404 | 2/1985 | Lowrance | 206/315.2 |

FOREIGN PATENT DOCUMENTS

| | | | |
|---|---|---|---|
| 124043 | 5/1947 | Australia | 206/315.6 |

*Primary Examiner*—David M. Mitchell
*Attorney, Agent, or Firm*—Keith S. Bergman

[57] ABSTRACT

A rigid container for golf clubs and accessories provides two spaced cylindrical compartments interconnected in their end parts to define a medial channel therebetween for containment of retracted wheel structures. The cylindrical compartments provide plural support tubes, each to carry a golf club in frictional engagement for positional maintenance. Foldable wheel structure carried in the medial channel extends therefrom to an operative position to provide means for wheeled locomotion and semi-vertical container support on an underlying surface. The container is covered by a traditional fabric bag.

4 Claims, 3 Drawing Sheets

60
38
61
55
53
54
58
58
54
59
57
59
56
61
62
39
21
60
20
63
75
67
70

60
39
61
55
62
40
20
63
70
67
21
75

82
30
43
42
80
41
2
83
81
23
81
55
84
64
62
21
63
2
33
75
32

20
60
61
55
39
38
62
21

55
39
53
38
54
54
58
64
56
57
20
62
66
21
76
77
65
63
73
71
74
67
67
68
69
70

55
58
64
65
20
21
62
73
74
71
72
67
70
69
68

20
24
79
79
62
62
25
78
21
76
76
75
77
69
63
67

46
47
44
45
22

50
51
52

Fig 10
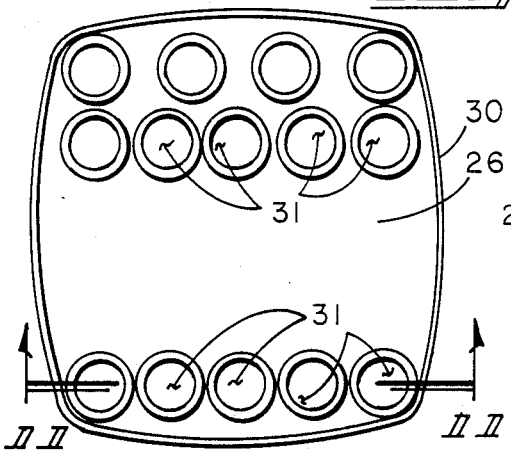
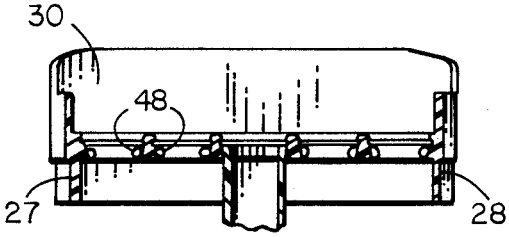
Fig 11
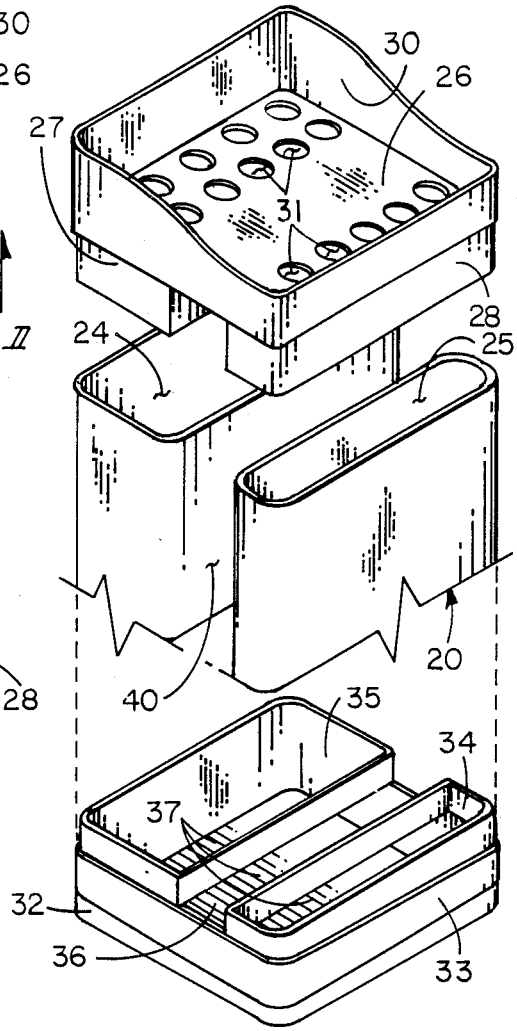
Fig 12
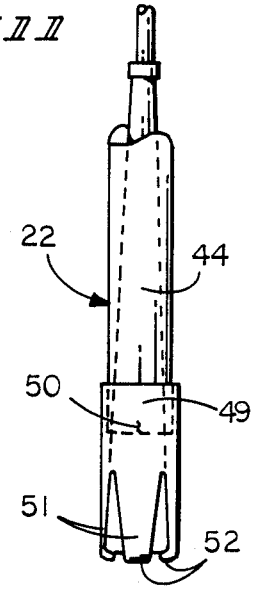
Fig 9

GOLF CLUB CONTAINER WITH EXTENSIBLE WHEELS

BACKGROUND OF INVENTION

RELATED APPLICATIONS

There are no applications related hereto heretofore filed in this or any foreign country.

FIELD OF INVENTION

My invention generally relates to containers for golf clubs and ancillary apparatus and more particularly to such a container having individual tubes to positionally maintain club shanks and extendible wheel structure to provide optional locomotion and support means.

BACKGROUND AND DESCRIPTION OF PRIOR ART

Containers of various sorts, generally of a bag-like nature, have long been used for collection, maintenance and storage of golf clubs and associated apparatus. Though such containers through their history have continuously improved in both sophistication and utility, various problems still remain with them. The instant invention provides a new member to this class of devices with improvements to resolve existing problems.

Since golf clubs must be used over substantially the entire area of a golf course, a container for them must provide some portability to be useful. In the early history of these devices, means were provided, such as handles or straps, for manual manipulation and carriage. As the containers developed and their sophistication increased, other mechanical means to aid locomotion developed, principally in the form of added wheels. Commonly such wheel structures were in the form of a separate mechanism not attached to a gold bag which it supported, though in the more recent development of the art, it has become known to structurally relate a bag and its wheel means to aid locomotion. The instant invention provides a container of this latter type that has relatively large wheels retractable within a medial channel defined in the container when not in use, but extendible for support in a rigid and sturdy fashion when positioned for use. This is in contradistinction to prior art devices which generally have provided either relatively small wheels which do not conveniently accomplish appropriate locomotion, especially over uneven surfaces, or in cases where larger wheels have been provided, have not provided wheel retracting mechanism that allows containment of larger wheels within the container structure itself. My invention allows these improvements while yet maintaining all of the normal amenities of traditional golf club containers heretofore known.

The traditional flexible bag-type golf club containers heretofore known have not in general provided means for separating and uniquely positionally maintaining clubs within the bag structure. As the sophistication of golf clubs has increased during the course of their history, so also has their cost and responsively it has become desirable to prevent golf clubs from randomly contacting each other in a container or other objects outside a container, especially during cartage, as this may and oftentimes does damage the clubs either aesthetically or functionally. Because of the rather unique configuration of a golf club, it is difficult to contain the clubs and prevent such damage without uniquely positionally maintaining them. Various structures and devices, principally in the form of straps or orifices to limit shaft motion in bag structures, have become known to serve this purpose, but in general such devices, though they have maintained a club shaft in a particular limited area, have not uniquely so maintained it, but rather have allowed a club to move rotatably about its shaft and generally have not too well restricted motion of the shaft itself within a containing structure.

My invention solves this problem by providing a container structure having individual elongate tubular elements extending substantially the length of the shank of a club with resiliently deformable means in the lower portion to frictionally engage a club handle to uniquely positionally maintain that handle especially against rotation. This type of structure has added benefits in that it provides a means for indicating and allowing determination of the absence of any particular club from a contained set and also in maintaining clubs in a container should the entire container be inverted or otherwise disposed so that gravity might cause the clubs to move therefrom, were they not frictionally maintained.

My invention further provides a rigid container that has a traditional fabric covering to preserve the aesthetic amenities and storage pouches of historic golf bags. The two wheel structures of my bag are arrayed in angulated fashion in their operative mode so that the bag itself serves as a third point for upright support of the entire structure. This angulated wheel structure also allows provision of a handle that may be used to manipulate my container during its locomotion over a supporting surface.

My invention resides not in anyone of these features per se, but rather in the synergistic combination of all of the structures, as hereinafter further specified and claimed.

SUMMARY OF INVENTION

My invention generally provides two rigid elongate containers structurally joined in spaced adjacency, to define a wheel chamber therebetween, by rigid bottom and top elements. Each container carries a plurality of elongate support tubes releasably supported between the top and bottom members. Each support tube provides a bottom portion to frictionally receive and releasably engage the handle end of a golf club. Similar cooperating wheels are journaled on pivotal mounting structures to fold within the wheel channel for storage and extend therefrom for wheeled locomotion of the container. The wheels are angulated to the container in their extended use mode to cooperate with the container to provide a three-point support in an upright position. A rigid handle is releasably carried by the container to aid locomotion.

The container is covered by a traditional fabric bag structure that provides storage for ancillary apparatus and devices and handle structure to aid manipulation.

In providing such a device, it is:

A principal object of my invention to create a rigid golf club container having two spaced cylinders each carrying a plurality of individual tubular elements to uniquely positionally maintain each golf club of a set, especially against rotary motion about their shanks.

A further object of my invention to provide such a container that has a pair of relatively large wheels journaled on foldable support structures for carriage within a medial wheel chamber defined in the container and for extension laterally outwardly therefrom to provide locomotion means for the container.

A further object of my invention to provide such a device that has a fabric covering providing the aesthetics and traditional amenities of fabric golf bags heretofore known.

A further object of my invention to provide such a device that is of lighter weight and lower bulk then separate traditional golf bag and cart structures associated for locomotion, but one that yet provides the benefits of both separate devices.

A still further object of my invention to provide wheel structure for such a golf club container that is of a unique mechanical nature, allows use of relatively large wheels and is of unusual rigidity and durability.

A still further object of my invention to provide such a device that is of new and novel design, of rugged and durable nature, of simple and economic manufacture and otherwise well adapted for the uses and purpose for which it is intended.

Other and further objects of my invention will appear from the following specification and accompanying drawings which form a part hereof. In carrying out the objects of my invention, however, it is to be remembered that its accidental features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout:

FIG. 9 is a view, similar to that of FIG. 8, showing the lower end portion of the tube with a club frictionally engaged therein.

FIG. 10 is an orthographic top or plan view of the top element of my invention, showing its containing tube channels.

FIG. 11 is a vertical cross-sectional view of the structure of FIG. 10, taken on the line 11—11 thereon in the direction indicated by the arrows.

FIG. 12 is a partial expanded isometric view of the rigid container cylinders, top, and bottom structures of my invention with the outer covering bag removed for clarity of illustration.

DESCRIPTION OF PREFERRED EMBODIMENT

Figure 3:
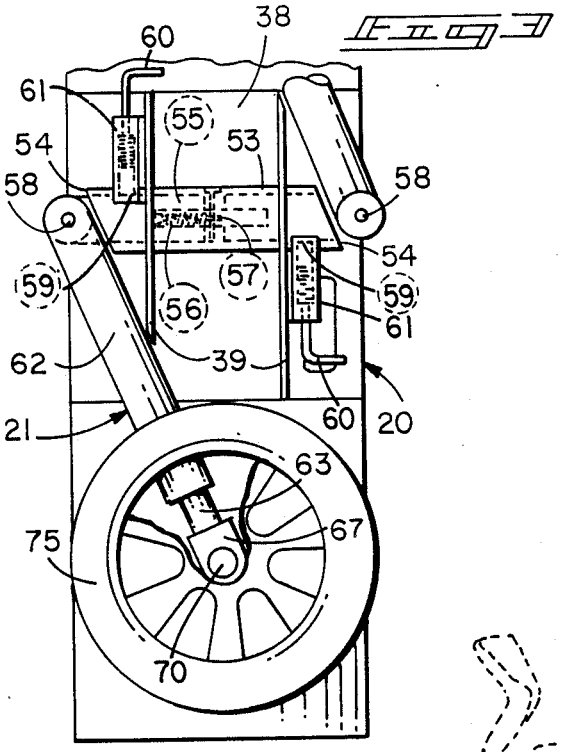
FIGS. 3–7 are somewhat enlarged isometric surface views of the wheel structures of my invention showing various parts thereof and their operation.
Figure 4:
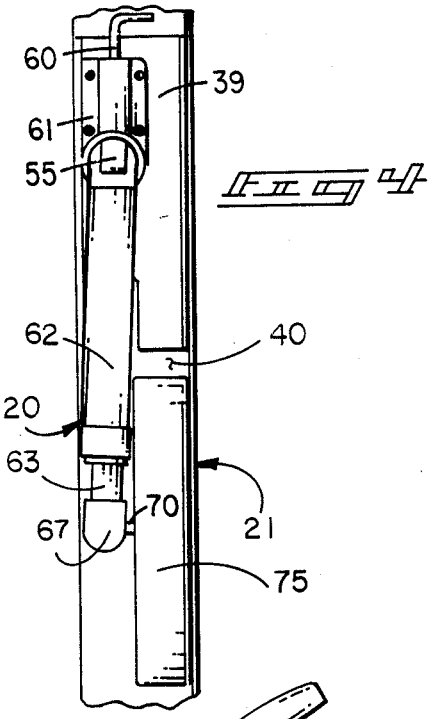

My invention generally provides shell-type rigid container 20 carrying extendible wheel structures 21 and plural club support tubes 22 with fabric covering 23 about the vertical surface thereof.

Shell-like container 20 provides peripherally defined areally larger club containing cylinder 24 and areally smaller club containing cylinder 25, each cylinder comprising elongate structures having a somewhat rectangular cross-section with rounded corners and similar lengths (vertical dimension), somewhat less than the length of the shafts of golf clubs to be supported. The cross-section of each container has similar lateral dimensions but differing forward-rearward dimensions. The larger forward club cylinder accommodate two rows of club support tubes while the smaller container accommodates one row of tubes, as illustrates especially in FIG. 12. The two elongate club cylinders are joined in spaced parallel adjacency by top and bottom elements.

As shown especially in FIGS. 11 and 12, the top element provides sheet-like top shelf 26 carrying forward depending collar 27 and rearward depending collar 28, both configured to fit immediately inwardly adjacent the inner surfaces of club cylinders 24 and 25, respectively. Rim 30 extends upwardly about periphery shelf element 26, and the shelf defines plural spaced support tube holes 31 in spaced array to support two rows of club tubes within forward larger club cylinder 24 and one row of club tubes within smaller rearward club cylinder 25. Preferably by tradition the club tube holes are arrayed as illustrated with a total of fourteen holes defined with four holes aligned along the forward edge of the shelf and five holes aligned immediately rearwardly thereof above the larger club cylinder and a row of five holes aligned above the smaller club cylinder to allow the woods and the irons to be maintained together in separated groups.

Bottom element 32 is of shape similar to shelf 26 of the top unit. The bottom element structurally carries upwardly extending peripheral side 33 which in turn carries upwardly extending rearward smaller connecting collar 34 and larger forward connecting collar 35, both configured to fit immediately inwardly adjacent the lower portions of the two club cylinders 24, 25, respectively. Lower medial cross-support support 36 communicates between the two connecting collars at their bases to provide additional support in this area. The upper surface of bottom element 32 defines a plurality of cells 37 to receive the lower portions of club support tubes 22 to cooperate with the support tube holes in shelf 26 of the top element to maintain the support tubes in appropriate spaced parallel array in the club cylinders.

This peripheral frame structure, comprising the two club cylinders, top and bottom elements, is formed of some reasonably lightweight rigid durable material such as one of the harder and more dense polymeric or resinous plastics. The exact configuration and dimensioning of the frame structure are not essential to my invention, though must be related to the traditional dimensions and configurations of golf clubs that are to be carried. The distance between the top and bottom member should be slightly less than the length of the shanks of golf clubs to be carried and the areas of the structures must be sufficient to allow indicated positioning of support tubes that are large enough to carry the shanks and handles of the golf clubs that they will ultimately support.

A support element having similar sides 38 interconnected by substantially perpendicular medial septa 39 extends between the adjacent facing surfaces of the two club cylinders 24, 25. The support element provides some additional structural integrity and rigidity for the frame structure, but more importantly, provides means for mounting the wheel structure in wheel channel 40. The particular size and configuration of this support element are not critical so long as the element serves its specified purpose and does not block the wheel chambers above and below it.

The uppermost portion of rearward smaller club cylinder 25 structurally carries handle arm support 41 defining a channel in which handle arm 42 is received in a frictional fit for releasable positional maintenance. The handle arm extends in a curvilinear fashion upwardly and rearwardly to carry handle 43, configured for conformable gripping, in its end part at a spaced distance rearwardly of the wheels of any container to provide means for manual manipulation during locomotion. The handle arm may be releasably maintained in support 41 otherwise than by frictional engagement, such as by mechanical fasteners (not shown) or the like.

Figures 2, 6, 7, 8:
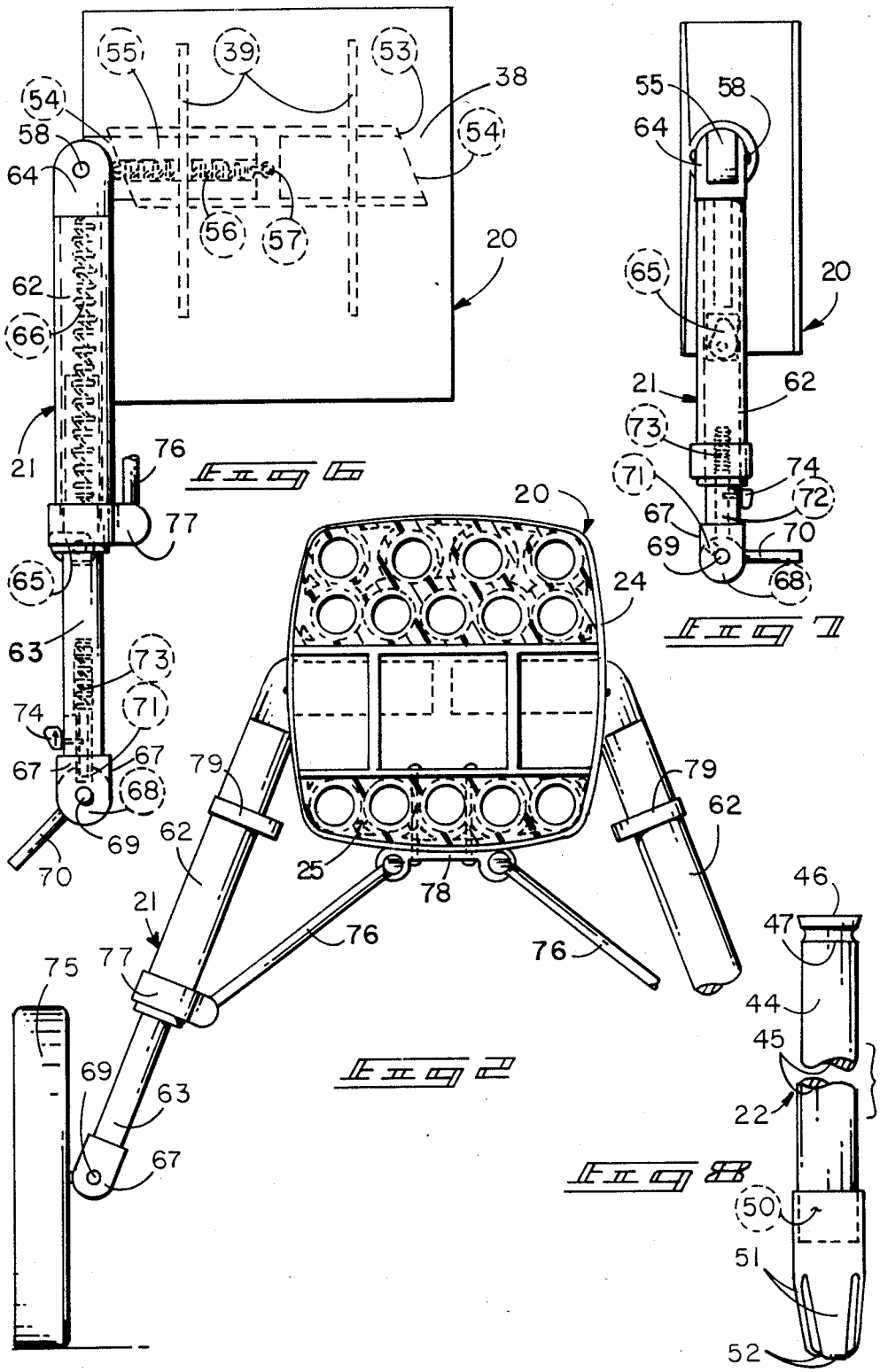
FIG. 2 is a cross-sectional view through the container of FIG. 1, taken on the line 2—2 thereon in the direction indicated by the arrows.
FIG. 8 is a partial orthographic side view of one of the club holding tubes of my invention.

Support tubes 22 are illustrated particularly in FIG. 8 and FIG. 9. These structures each provide elongate tubular body 44 defining medial channel 45 with outwardly flaring top portion 46 to aid insertion of a club handle therein and matingly interfit within tube holes 31 of shelf element 26. Annular fastening groove 47 is defined in the outer surface of the tubular body, immediately inwardly adjacent flaring top portion 46, to cooperate with inwardly extending annular bosses 48, defined about the periphery of the support tube holes 31 in the shelf element, to provide releasable positioning of the upper portion of a support tube relative to the shelf element. In the illustrations, the lower portion of tubular body 44 carries a fastening foot providing cylindrical body 49 defining channel 50 that receives a lower peripheral surface of an associated tube in a frictional fit. The lower portion of the fastening foot provides plural fastening fingers 51 having radially inwardly extending lowermost portions 52. The fastening fingers are formed of some semi-rigid, resiliently deformable material, such as a polymeric plastic, to the configuration illustrated with the fingers extending radially inwardly sufficiently that, as illustrated in FIG. 9, they will expand to some degree to create sufficient frictional force to positionally maintain a golf club handle placed therein is a releasable fashion. The amount of frictional force may be regulated by the configuration and nature of the material from which the fingers are formed. The same type of frictional engagement of a club handle in the lowermost portion of a tube may be accomplished by other types of tube deformation (not shown), with or without a separable foot structure, and remain within the ambit and scope of my invention.

Preferably the support tube structure is formed of a harder dense plastic, though undoubtedly it might be formed of other materials such as of the less dense metals. The length of tubular body 44, including the fastening foot portion, in somewhat less than the length of the shank of a golf club to be supported therein and the diameter of the tubular body is as large as the largest diameter of the handle of a golf club to be carried by the tube to allow insertion within a tube. The cells defined in the bottom element are of appropriate size to receive the lowermost portion of support tubes when expanded in a condition to frictionally engage a club handle.

Wheel structure 21 is shown particularly in Figures 2–6 where it is seen that tubular mounting sleeve 53 is carried by vertical septa 39 of the support element in a perpendicular, laterally extending orientation. This mounting tube provides angulated ends 54 to allow the wheel mounting structures supported therein to move into the medial wheel channel. Similar opposed strut supports 55 are pivotally carried in each end of mounting tube 53 to extend beyond the mounting tube a distance sufficient to pivotally mount struts thereon. The strut supports each carry medial extending springs 56 in their end part to communicate with pin 57 carried by the middle portion of mounting tube 53 to maintain the strut supports within the mounting tube and bias them to an inward position. The outer end portion of each strut support carries pin 58 to pivotally mount the primary struts thereon. The medial portion of the strut supports define indentations 59 to receive pin 60 of inwardly biased catch structure 61 to releasably maintain the strut support in a particular rotary position in the mounting tube to appropriately position those structures for operative wheel support.

Each primary wheel strut is a compound structure providing larger strut tube 62 slidably and rotatably carrying smaller strut tube 63 extending from its outer end portion. The inner end portion of the larger strut tube carries yoke 64 which pivotally mounts upon pin 58 carried by strut support 55. The yoke fits within the larger strut tube and provides a solid medical structure for that tube. The inner end portion of smaller strut tube 63 carries pivotally mounted cam 65 extendible through a slot defined in that tube to fastenably engage the outermost end part of larger strut tube 62, as shown in FIG. 6, to releasably fasten the two strut tubes in extended relationship relative to each other. This cam is biased to a fastening position and the smaller tube 63 biased to a retracted position by extension spring 66 carried between the yoke structure and the cam within the medial channel defined by the smaller strut tube. The cam 65 is released from its fastening position, shown in FIG. 6, by manually moving smaller strut tube 63 outwardly of the strut tube 62 so that the cam can be accessed and moved manually inward within the channel of the smaller strut tube which is then rotated slightly to maintain the cam in this position.

End portion of smaller strut tube 63 carries wheel mounting yoke 67 extending thereabout and pivotally carrying wheel mounting cylinder 68 journaled on pin 69 carried by the yoke. This wheel cylinder carries radially extending axle 70 upon which wheel 75 is journaled. Wheel cylinder 68 defines a radially aligned fastening hole 71 to receive pin 72 carried in the smaller strut tube and biased to an outward position by compression spring 73 to positionally maintain the rotary orientation of the cylinder in a wheel supportative position relative the strut structure. This pin may be moved out of its fastening hole by slidable catch 74 carried in an appropriate slot defined in the end portion of the smaller strut tube to communicate with the spring, release the spring bias and move pin 72. With this structure then, a journaled wheel may be releasably maintained in operative angular position in a plane through the axis of the strut tubes.

An auxiliary support strut 76 is pivotally carried by annular support 77, which in turn is carried about the outer end portion of each larger strut tube 62, to extend angularly inwardly to fastening bracket 78 carried on the upper part of rearward smaller club cylinder 25. This strut 76 provides enlarged end part 79 for releasable carriage in a channel defined by fastening bracket 78. The auxiliary support strut during storage is pivoted parallel to larger strut tube 62 supporting it, where it is releasably maintained by resilient annular catch 79.

Wheels 75 are limited in size only by the length of the wheel channel defined between the club cylinder and the amount of space occupied by the support element carried in the medial part thereof. With an ordinary sized golf club container adapted for use with clubs of modern configuration, this allows the use of a wheel of approximately ten inch diameter. Preferably the width of the container structures, that is their lateral dimension, is substantially the same as the diameter of a wheel so that at least a substantial portion of a wheel may be carried within the wheel channel, as illustrated in FIG. 3. The wheel support structure is formed of some rigid, reasonably durable light-weight material such as a plastic or lighter metal. The structure is sufficiently rigid and durable to allow the use of either material by reason of its particular configuration.

Fabric covering 23 provides bag-like structure 80 formed of flexible material configured to cover the periphery of the rigid frame structure. The covering provides traditional zipper closable pouches 81 and handles 82 providing carriage means. It also provides zippered openings 83 on each lateral side to allow access to wheel structures and defines orifices 84 to allow the passage of the wheel struts therethrough. One of the pouches 81 should be of appropriate size and configuration to contain handle arm 42, but in the traditional golf bag design one pouch normally is of such size. The fabric covering may be formed of the traditional materials and with the historic configuration of golf bags heretofore known. This covering is not novel, per se, but merely constitutes a necessary ancillary element required for the complete and most desirable operability of my invention.

Having thusly described my invention, its operation may be understood.

Firstly, a golf club container is formed according to the foregoing specifications. In its storage mode, it will have the appearance of an ordinary golf bag heretofore known, with its wheel structures stored in the wheel chamber defined between club cylinder elements and the handle arm stored in one of the pouches of the fabric covering structure.

To erect the container to its use mode, zippered wheel closures 83 are opened and wheels 75 moved outwardly of the wheel channel 40. Smaller strut tubes 63 are extended from larger tubes 62 until fastening cams 65 engaged in the outer end part of the larger tubes, as evidenced by a sensible click and the inability to move the strut any further outwardly. The strut structures are then pivoted through approximately a right angle so that they extend perpendicularly to strut support 55 and as this position is attained, auxiliary support struts 76 are released from their retaining catches 79 and interconnected in the closest side of fastening bracket 78 to properly angularly orient the primary wheel struts in a rearward angulated position relative to the container. Wheel 75 are then pivoted relative to their supporting strut structures, to the angulated positions illustrated in FIG. 2, whereat they are releasably maintained by catch pins 72.

Figure 1:
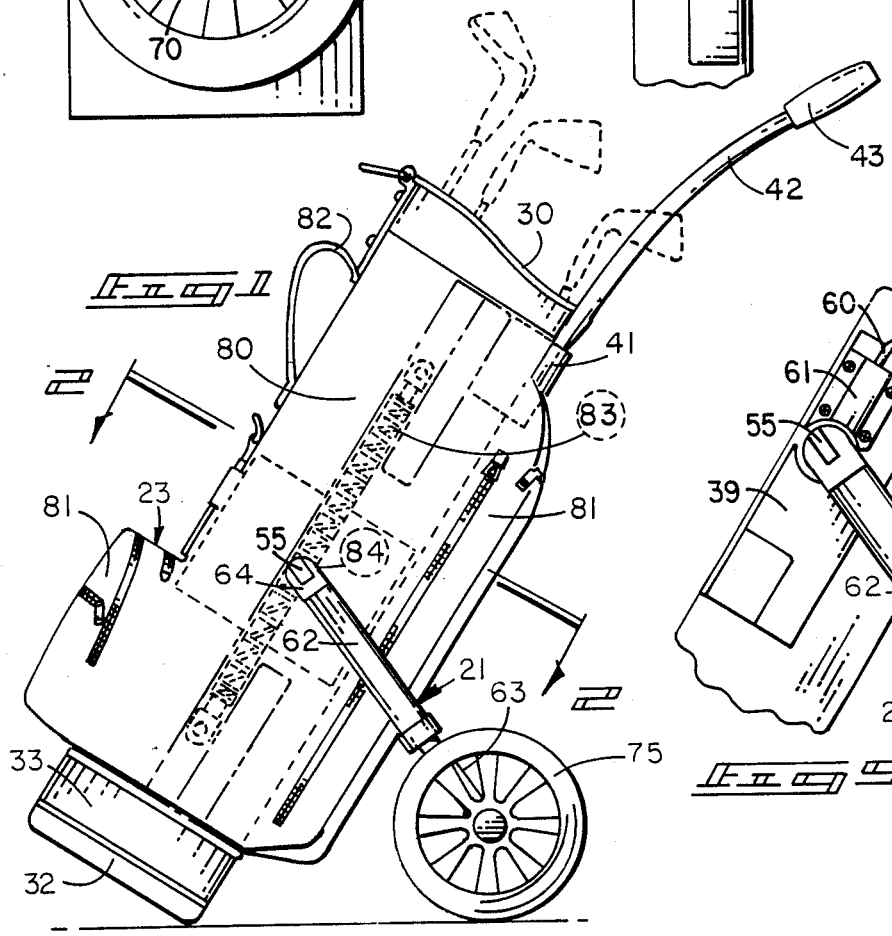
FIG. 1 is an orthographic side view of my invention in use mode with wheels extended, showing its various parts, their configuration and relationship.
Figure 5:
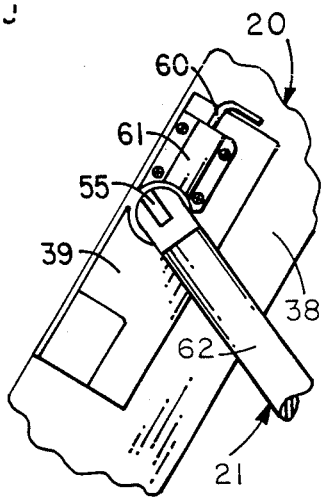

The same manipulation is accomplished with both wheel structures and the device is then in its use mode and supported on an underlying supportative surface in a three-point fashion by the two wheels and the rearward portion of the bottom element. Handle arm 42 is then removed from its carrying pouch and attached in handle arm bracket 41, in the position illustrated in FIG. 1, to aid manual manipulation of the container during use and particularly for locomotion.

Disassembly of the structure from its use mode is accomplished in the reverse fashion of that described for its assemblage.

To place a club in a support tube 22, the club is merely inserted, handle first, into the tube and moved, or allowed to move by gravity, downwardly until the handle engages the lowermost fastening portion of the carrying tube and is frictionally engaged therewith. The downward motion of the club will be limited by the lowermost portion of the tube or the bottom element therebeneath, as the case may be, so that a club cannot move too far downwardly. The nature of the frictional engagement between a tube and a golf club handle may be regulated by configurational or material parameters to accomplish the desired frictional conditions. A club is removed from a support tube by similar reversed manual manipulation. It is to be noted that a golf club once inserted will be releasably positionally maintained against both rotary forces about its shank and elongate forces parallel thereto, with the club handle uniquely restrained and club top constrained within a reasonably small area by the upper opening of the channel in the support tube.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent, and what I claim is:

1. A container for golf clubs and ancillary apparatus comprising, in combination:

two elongate, peripherally defined club cylinders spacedly joined by top and bottom elements to form a wheel channel therebetween with a support carried between the cylinders in the medial portion of the wheel channel, said top element defining a plurality of tube hole above both club cylinders to releasably and fastenably receive the upper portion of a plurality of support tubes and said bottom element having an upper surface defining a plurality of spacedly arrayed cells below both club cylinders to receive and support the plurality of support tubes, carried in the holes defined in the top member, in substantially parallel array in the club cylinders;

a plurality of support tubes carried in the tube holes defined in the top member and extending downwardly to the cooperating cells in the bottom member, each support tube defining a channel to receive the handle and shaft of a golf club and having releasable fastening means to cooperate with the hole structure to releasably maintain a tube therein; and a wheel structure having a mounting tube, carried by the support in the medial portion of the wheel channel, to extend laterally beyond opposite sides of the wheel channel, said mounting tube pivotally carrying at each end a strut support having releasable catch means for maintaining one angular position wherein wheels are supported for locomotion and having a portion extending laterally outwardly at each end to carry a pin to pivotally mount a strut, a compound strut carried by each strut support and having two slidably extendible relatively rotatable members with first means for releasably maintaining a particular extended position and second means for biasing the tubes towards a non-extended position, the outer portion of each strut carrying wheel mounting yokes which pivotally carry rotatable cylinders with radially extending wheel mounting axles and means for releasably maintaining a particular radial position of the rotatable cylinders, and wheels journaled on each of said wheel mounting axles, each of said wheels being containable in one of the compartments vertically adjacent the medial support in the wheel channel.

2. The invention of claim 1 further characterized by:

an elongate upwardly extending handle arm releasably carried by the upper portion of a club cylinder to aid manual manipulation of the container.

3. The invention of claim 1 having a flexible fabric bag about the periphery of the club cylinders, said bag defining zippered orifices outwardly adjacent orifices of the wheel channel to allow passage of wheel support structure through the bag, and plural pockets for containment of ancillary apparatus.

4. A container for golf clubs and ancillary apparatus comprising, in combination:

two elongate, periphery defined club cylinders spacedly joined by a top element and a bottom element to form a wheel channel therebetween with a support carried between the cylinders in the medial portion of the wheel channel, said top element defining a plurality of tube holes above both club cylinders and having means to releasably and fastenably receive the upper portion of a plurality of support tubes and said bottom element having an upward facing surface defining a plurality of spacedly arrayed cells to receive and support the plurality of support tubes carried in the holes defined in the top member in substantially parallel array in the club cylinders; and wheel structure having a mounting tube carried by the support in the medial portion of the wheel channel and pivotally carrying at each end strut supports with releasable catch means for maintaining one angular position wherein the wheels are supported for locomotion and with a portion extending laterally outwardly at each end to pivotally mount a compound strut, compound struts carried by each strut support, each strut having two slidably extendible and relatively rotatable members with first means for releasably maintaining a particular extended position and second means for biasing the strut members towards a non-extended position, the outer portion of each compound strut carrying a wheel mounting yoke rotatably carrying a wheel cylinder with a radially extending wheel mounting axle and means for releasably maintaining a particular radial position of the wheel cylinder, and wheels journaled on each wheel mounting.

* * * * *